United States Patent [19]

Baillargeon et al.

[11] Patent Number: 5,039,309

[45] Date of Patent: Aug. 13, 1991

[54] MULTIFUNCTIONS ADDITIVES TO IMPROVE THE LOW-TEMPERATURE PROPERTIES OF DISTILLATE FUELS AND COMPOSITIONS THEREOF

[75] Inventors: David J. Baillargeon, Cranbury; Angeline B. Cardis, Florence; Dale B. Heck, West Deptford, all of N.J.

[73] Assignee: Mobil Oil Corporation, Fairfax, Va.

[21] Appl. No.: 449,167

[22] Filed: Dec. 13, 1989

[51] Int. Cl.[5] ..... C10L 1/14

[52] U.S. Cl. ..... 44/331; 44/391; 525/419; 564/134; 564/144; 564/169

[58] Field of Search ..... 44/62, 71, 75, 78, 63; 525/419; 564/134, 144, 169

[56] References Cited

U.S. PATENT DOCUMENTS

| | | | |
|---|---|---|---|
| 2,594,145 | 4/1952 | Flory | 525/420 |
| 3,397,255 | 8/1968 | Coats et al. | 525/437 |
| 3,882,085 | 5/1975 | Schmitt et al. | 525/420 |
| 4,061,621 | 12/1977 | Lofquist | 525/420 |
| 4,236,989 | 12/1980 | Davis et al. | 44/72 |
| 4,290,778 | 9/1981 | Herbstman et al. | 44/91 |
| 4,328,142 | 5/1982 | Hertel et al. | 525/420 |
| 4,402,708 | 9/1983 | Oswald | 44/62 |
| 4,404,001 | 9/1983 | Kaufman | 44/71 |
| 4,430,093 | 2/1984 | Jenkins, Jr. | 44/70 |
| 4,659,337 | 4/1987 | Sung | 44/71 |
| 4,690,980 | 9/1987 | Singer et al. | 525/286 |
| 4,732,948 | 3/1988 | McCready et al. | 525/437 |
| 4,744,798 | 5/1988 | Andress | 44/63 |

*Primary Examiner*—Margaret B. Medley
*Attorney, Agent, or Firm*—Alexander J. McKillop; Charles J. Speciale; Howard M. Flournoy

[57] ABSTRACT

Additives comprising the reaction products of aminodiols and the product of pyromellitic dianhydride and aminoalcohols and/or amines with long-chain hydrocarbyl groups improve the low-temperature properties of distillate fuels.

40 Claims, No Drawings

MULTIFUNCTIONS ADDITIVES TO IMPROVE THE LOW-TEMPERATURE PROPERTIES OF DISTILLATE FUELS AND COMPOSITIONS THEREOF

BACKGROUND OF THE INVENTION

This invention is directed to novel additives to improve the low-temperature characteristics of liquid hydrocarbyl fuels, especially distillate fuels and to fuel compositions containing them.

Traditionally, the low-temperature properties of distillate fuels have been improved by the addition of kerosene, sometimes in very large amounts (5–70 wt %). The kerosene dilutes the wax in the fuel, i.e. lowers the overall weight fraction of wax, and thereby lowers the cloud point, filterability temperature, and pour point simultaneously. The additives of this invention effectively lower both the cloud point and CFPP of distillate fuel without any appreciable dilution of the wax component of the fuel.

Other additives known in the art have been used in lieu of kerosene to improve the low-temperature properties of distillate fuels. Many such additives are polymeric materials with pendant fatty hydrocarbon groups, and are usually derived from the free radical polymerization of unsaturated hydrocarbons (olefins, acrylates, fumarates, etc.). These additives are limited in their range of activity, however; most improve fuel properties by lowering the pour point and/or filterability temperature. These same additives have little or no effect on the cloud point of the fuel.

Applicants, to the best of their knowledge are unaware of any art that teaches or suggests the additive products disclosed herein. For example, U.S. Pat. No. 4,524,007 discloses the use of polycarboxylic mellitic anhydride acids, anhydrides such as pyromellitic anhydride (PMDA) reacted with ether capped alcohols to provide demulsifying additives for lubricants.

The additives of this invention are substantially different, however, both in terms of structure and function. The oligomeric and/or polymeric materials obtained via condensation reaction, e.g. the reaction of aminodiols with acids and/or anhydrides. In terms of activity, these additives effectively lower distillate fuel cloud point, thus providing improved low-temperature fuel properties, and offering a unique and useful advantage over known distillate fuel additives.

SUMMARY OF THE INVENTION

Novel oligomeric/polymeric pyromellitate esters/amides have been prepared and have been found to be surprisingly active wax crystal modifier additives for distillate fuels. Distillate fuel compositions containing such additives demonstarate significantly improved low-temperature flow properties, with lower cloud point and lower CFPP (cold filter plugging point) filterability temperature.

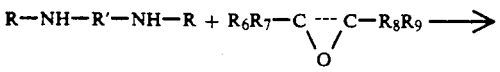

These oligomeric/polymeric additives are the reaction products derived from two types of monomer components. The first monomer type is an aminodiol, either alone or in combination with other aminodiols. The second monomer type is the reactive acid/anhydride product, either alone or in combination with other such monomers, derived from the reaction of pyromellitic dianhydride (PMDA) with either (a) an aminoalcohol, the product of an amine and an epoxide, or (b) a combination of an aminoalcohol (above, a) and an amine.

These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

The additive compositions, described in this application, which have cloud point activity and CFPP activity are unique in structure and activity. The additive concentrates and fuel compositions containing such additives are also unique. Similarly, the processes for making these additives, additive concentrates, and fuel compositions are unique.

DESCRIPTION OF SPECIFIC EMBODIMENTS

The additive of this invention have oligomeric (i.e. dimers, trimers, etc.) and/or polymeric structures. Various hydrocarbyl groups especially groups containing linear paraffinic substructures, are distrubuted along the backbone of the oligomer and/or polymer, and may be carried by either or both of the comonomers used.

As stated hereinabove, one of the comonomers, alone or in combination, used in the synthesis of these additives is an aminodiol. Any aminodiol may be used in this invention and may include, but is not limited by, examples given below.

One class of aminodiols are those diols derived from the reaction of a primary amine with two or more equivalents of an epoxide:

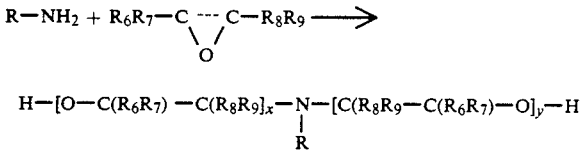

where $x+y \geqq 2$ $R = C_1$ to $C_{100}$ hydrocarbyl, or hydrocarbyl containing phosphorus, nitrogen, sulfur and/or oxygen.

$R_6, R_7, R_8, R_9$ = hydrogen, $C_1$ to $C_{100}$ hydrocarbyl, or hydrocarbyl containing phosphorus, nitrogen, sulfur and/or oxygen.

A second class of aminodiols are those diols derived from the reaction of a bis-secondary amine with two or more equivalents of an epoxide:

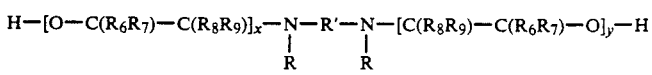

where:

$x+y \geqq 2$

R, R′ = $C_1$ to $C_{100}$ hydrocarbyl, or hydrocarbyl containing phosphorus, nitrogen, sulfur and/or oxygen.

$R_6$, $R_7$, $R_8$, $R_9$ = hydrogen, $C_1$ to $C_{100}$ hydrocarbyl, or hydrocarbyl containing phosphorus, nitrogen, sulfur and/or oxygen.

Any suitable amine may be used. They may be primary or bis-(or poly-) secondary, aliphatic or aromatic, substituted or unsubstituted. For example, amines such as hydrogenated tallow amine, aniline, piperazine and n-octylamine are suitable.

Included within the scope of the epoxides useful herein are 1,2-epoxydecane, 1,2-epoxydodecane, 1,2-epoxytetradecane, 1,2-epoxypentadecane, 1,2-epoxyhexadecane, 1,2-epoxyheptadecane, 1,2-epoxyoctadecane, 1,2-epoxyeicosane and mixtures thereof, and any olefin epoxide or alkylene oxide such as ethylene oxide or combinations thereof and the like. Especially preferred is 1,2-epoxyoctadecane.

The reaction conditions for the preparation of the aminodiols is as follows: 80°-250° C. for 1-24 hrs., under autogenous pressure to 25 atmospheres.

The temperature chosen will depend upon for the most part on the particular reactants and on whether or not a solvent is used. Solvents used will typically be hydrocarbon solvents such as xylene, but any non-polar, unreactive solvent can be used including benzene and toluene and/or mixtures thereof.

Molar ratios of epoxide/primary amine are generally 2:1, and molar ratios of epoxide/secondary amine are generally 1:1 for each reactive amine group.

The other comonomer, alone or in combination, used in the synthesis of these additives is a reactive acid and/or anydride derived from the reaction of pyromellitic dianhydride (PMDA) or its acid equivalent, and suitable pendant groups derived from alcohols and amines with some combination of linear hydrocarbyl groups attached. These pendant groups include (a) aminoalcohols, derived from a secondary amine capped with an olefin epoxide, (b) combinations of the aminoalcohol from (a) and an amine, and (c) combinations of two or more different aminoalcohols.

The aminoalcohol used above is the reaction product of an epoxide and a secondary amine, in substantially 1:1 molar ratio, with the preferred embodiment being the reaction product of 1,2-epoxyoctadecane and di(hydrogenated tallow) amine.

The amine used above may be any secondary amine, with each substituent being independently $C_1$-$C_{100}$ hydrocarbyl, or hydrocarbyl containing O, N, S, P.

The additives of this invention are the reaction products obtained by combining the two monomer types described above in differing ratios using standard esterification techniques according to the following stepwise procedure:

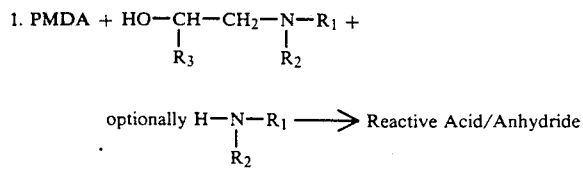

-continued

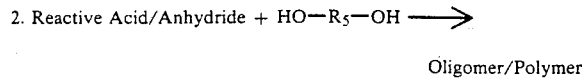

Where HO—$R_5$—OH = aminodiols(s) described above.

For example, a general structure for the oligomers/polymers derived from PMDA partial ester and aminodiol is as follows:

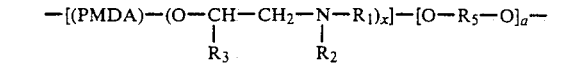

A general structure for the oligomers/polymers derived from PMDA mixed partial ester and aminodiol is as follows:

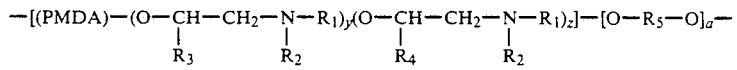

A general structure for the oligomers/polymers derived from PMDA partial ester/amide and aminodiol is as follows:

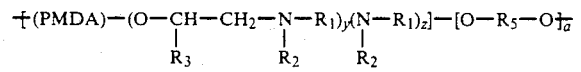

Where:

x = y + z = 0.5 to about 3.5 and preferably 1 to about 3.

a = 0.25 to 2, and preferably 0.5 to about 1.25.

$R_1$, $R_3$ = $C_8$ to $C_{50}$ linear hydrocarbyl groups, either saturated or unsaturated.

$R_2$ = $R_1$, $C_1$ to $C_{100}$ hydrocarbyl, or hydrocarbyl containing phosphorus, nitrogen, sulfur and/or oxygen.

$R_4$ = hydrogen, $C_1$-$C_{100}$ hydrocarbyl, or hydrocarbyl containing phosphorus, nitrogen, sulfur and/or oxygen.

$R_5$ = amine-containing hydrocarbyl sub-structure of the aminodiol(s) defined above.

More than molar, less than molar or substantially molar ratios of the PMDA reactive acid/anhydrive and the aminoalcohols may be used. The temperature may vary from about 100°-250° C. (preferably 150°-225° C.) for 1-24 hrs. at pressures varying from 0.001 atm. to about 10 atm. pressure.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% by weight of the total weight of the composition. These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterizes the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specifications D396-48T. Specifications for diesel fuels are defined in A.S.T.M. Specification D975-48T, Typical jet fuels are defined in Military Specification MIL-F-5624B.

The following examples are illustrative only and are not intended to limit the scope of the invention.

EXAMPLES

EXAMPLE 1

Preparation of Additive 1

Aniline (1.55 g, 0.017 mol; e.g. from Aldrich Chemical Company), and 1,2-epoxyoctadecane (33.6 g, 0.125 mol; e.g. Vikolox 18 from Viking Chemical) were combined and heated at 160° to 190° C. for 18 to 24 hours. Di(hydrogenated tallow) amine (50.0 g, 0.10 mol; e.g. Armeen 2 HT form Akzo Chemie) was added to the reaction mixture at 120° C., and then heated at 165 to 185° C. for 18 to 24 hours. Pryromellitic dianhydride (7.27 g, 0.033 mol; e.g. PMDA from Allco Chemical Corporation) and xylene (approximately 50 ml) were added and heated at reflux (140° to 230° C.), with azeotropic removal of water for 24 hours. Volatiles were then removed from the reaction medium at 190° to 200° C., and the reaction mixture was hot filtered through diatomaceous earth to give 93.4 g of the final product.

EXAMPLE 2

Preparation of Additive 2

According to the procedure used for Example 1, aniline (2.51 g, 0.027 mol), and 1,2-epoxyoctadecane (48.3 g, 0.180 mol) were combined. Di(hydrogenated tallow) amine (45.0 g, 0.090 mol) was then added and reacted. Pyromellitic dianhydride (7.85 g, 0.036 mol) and xylene (approximately 50 ml) were added to the mixture and allowed to react. After isolation, 92.3 g of the final product was obtained.

EXAMPLE 3

Preparation of Additive 3

According to the procedure used for Example 1, piperazine (1.44 g, 0.017 mol, e.g. from Aldrich Chemical Company) and 1,2-epoxyoctadecane (44.8 g, 0.167 mol) were combined. Di(hydrogenated tallow) amine (50.0 g, 0.100 mol) was added and reacted. Then, pyromellitic dianhydride (7.27 g, 0.033 mol) and xylene (approximately 50 ml) were added and allowed to react. After isolation, 96.9 g of the final product was obtained.

EXAMPLE 4

Preparation of Additive 4

According to the procedure used for Example 1, piperazine (3.88 g, 0.045 mol), and 1,2-epoxyoctadecane (60.4 g, 0.225 mol) were combined. Di(hydrogenated tallow) amine (45.0 g, 0.090 mol) was added and reacted at 200° C. Then, pyromellitic dianhydride (10.8 g, 0.050 mol) and xylene (approximately 50 ml) were added and allowed to react. After isolation, 99.2 g of the final product was obtained.

EXAMPLE 5

Preparation of Additive 5

According to the procedure used for Example 1, n-octylamine (2.15 g, 0.017 mol; e.g. Aldrich Chemical Company), and 1,2-epoxyoctadecane (44.8 g, 0.167 mol) were combined. Di(hydrogenated tallow) amine (50.0 g, 0.100 mol) was added and reacted. Then, pyromellitic dianhydride (7.27 g, 0.033 mol) and xylene (approximately 50 ml) were added and allowed to react. After isolation, 93.9 g of the final product was obtained.

EXAMPLE 6

Preparation of Additive 6

According to the procedure used for Example 1, n-octylamine (5.82 g, 0.045 mol), and 1,2-epoxyoctadecane (60.4 g, 0.225 mol) was combined. Di(hydrogenated tallow) amine (45.0 g, 0.090 mol) was added and reacted. Then, pyromellitic dianhydride (10.8 g, 0.050 mol) and xylene (approximately 50 ml) were added and allowed to react at 200° C. After isolation, 107.0 g of the final product was obtained.

EXAMPLE 7

Preparation of Additive 7

According to the procedure used for Example 1, hydrogenated tallow amine (4.31 g, 0.017 mol; Armeen HT from Akzo Chemie), and 1,2-epoxyoctadecane (44.8 g, 0.167 mol) were combined. Di(hydrogenated tallow) amine (50.0 g, 0.100 mol) was added and reacted. Then, pyromellitic dianhydride (7.27 g, 0.033 mol) and xylene (approximately 50 ml) were added and allowed to react at 200° C. After isolation, 95.9 g of the final product was obtained.

EXAMPLE 8

Preparation of Additive 8

According to the procedure used for Example 1, hydrogenated tallow amine (11.6 g, 0.045 mol), and 1,2-epoxyoctadecane (60.4 g, 0.225 mol) were combined. Di(hydrogenated tallow) amine (45.0 g, 0.090 mol) was added and reacted. Then, pyromellitic dianhydride (10.8 g, 0.050 mol) and xylene (approximately 50 ml) were added and allowed to react at 200° C. After isolation, 116.1 g of the final product was obtained.

EXAMPLE 9

Preparation of Additive 9

According to the procedure used for Example 1, di(hydrogenated tallow) amine (50.0 g, 0.100 mol), and 1,2-epoxyoctadecane (33.6 g, 0.125 mol) were combined. Then, Ethomeen T/12 (5.77 g, 0.017 mol; an aminodiol derived from tallow amine and two equivalents of ethylene oxide, e.g. from Akzo Chemie), pyromellitic dianhydride (8.00 g, 0.037 mol) and xylene (approximately 50 ml) were added and allowed to react at 200° C. After isolation, 90.7 g of the final product was obtained.

EXAMPLE 10

Preparation of Additive 10

According to the procedure used for Example 1, di(hydrogenated tallow) amine (50.0 g, 0.100 mol), and 1,2-epoxyoctadecane (33.6 g, 0.125 mol) were combined. Then, Ethomeen T/12 (19.0 g, 0.055 mol), pyromellitic dianhydride (12.0 g, 0.055 mol) and xylene (approximately 50 ml) were added and allowed to react at 200° C. After isolation, 102.0 g of the final product was obtained.

EXAMPLE 11

Preparation of Additive 11

According to the procedure used for Example 1, di(hydrogenated tallow) amine (50.0 g, 0.100 mol), and 1,2-epoxyoctadecane (33.6 g, 0.125 mol) were combined. Then, Ethomeen T/15 (7.98 g, 0.017 mol; an aminodiol derived from tallow amine and five equivalents of ethylene oxide, e.g. from Akzo Chemie), pyromellitic dianhydride (8.00 g, 0.037 mol) and xylene (approximately 50 ml) were added and allowed to react at 200° C. After isolation, 90.1 g of the final product was obtained.

EXAMPLE 12

Preparation of Additive 12

According to the procedure used for Example 1, di(hydrogenated tallow) amine (50.0 g, 0.100 mol), and 1,2-epoxyoctadecane (33.6 g, 0.125 mol) were combined. Then, Ethomeen T/15 (26.3 g, 0.055 mol), pyromellitic dianhydride (12.0 g, 0.055 mol) and xylene (approximately 50 ml) were added and allowed to react at 200° C. After isolation, 108.7 g of the final product was obtained.

EXAMPLE 13

Preparation of Additive 13

According to the procedure used for Example 1, piperazine (3.88 g, 0.045 mol), and 1,2-epoxyoctadecane (38.5 g, 0.135 mol) were combined. Di(hydrogenated tallow) amine (45.9 g, 0.090 mol), was added and reacted. Then pyromellitic dianhydride (9.82 g, 0.045 mol) and xylene (approximately 50 ml) were added and allowed to react at 200° C. After isolation, 87.9 g of the final product was obtained.

Preparation of Additive Concentrate

A concentrate solution of 100 ml total volume was prepared by dissolving 10 g of additive in mixed xylenes solvent. Any insoluble particulates in the additive concentrate were removed by filtration before use.

Test Procedures

The cloud point of the additized distillate fuel was determined using two procedures:

(a) an automatic cloud point test based on the equipment/procedure detailed in U.S. Pat. No. 4,601,303; the test designation is "AUTO CP";

(b) an automatic cloud point test based on he commercially availabe Herzog cloud point tester; the test designation is "HERZOG".

The low-temperature filterability was determined using the Cold Filter Plugging Point (CFPP) test. This test procedure is described in *Journal of the Institute of Petroleum*, Volume 52, Number 510, June 1966, pages 173–185.

The characteristics of Diesel Fuel A and B were as follows:

| Test Fuel Characteristics | FUEL A | FUEL B |
|---|---|---|
| API Gravity | 35.5 | 34.1 |
| Cloud Point, °F. | | |
| Auto CP | 15 | 22 |
| Herzog | 16.4 | 23.4 |
| CFPP, °F. | 9 | 16 |
| Pour Point, °F. | 10 | 0 |

TABLE

Additive Effects on the Cloud Point and Filterability (CFPP) of Distillate Fuel (Additive Concentration = 0.1 wt %) Improvement in Performance Temperature (°F.)

| | Diesel Fuel A Cloud Point | | | Diesel Fuel B Cloud Point | | |
|---|---|---|---|---|---|---|
| ADDITIVE | (AUTO CP) | (HERZOG) | CFPP | (AUTO CP) | (HERZOG) | CFPP |
| 1 | 3 | 2.2 | 4 | 7 | 6.7 | 9 |
| 2 | 3 | 2.5 | 6 | 7 | 7 | 6 |
| 3 | — | 1.8 | 6 | — | 6.8 | 9 |
| 4 | — | 2 | 6 | — | 7.2 | 11 |
| 5 | 3 | 2.2 | 6 | 7 | 6.8 | 9 |
| 6 | — | 1.8 | 6 | — | 6.8 | 11 |
| 7 | 2 | 2 | 6 | 7 | 6.5 | 7 |
| 8 | — | 1.8 | 4 | — | 5.9 | 7 |
| 9 | 2 | 1.6 | 6 | 7 | 6.3 | 9 |
| 10 | 2 | 2 | 4 | 7 | 6.6 | 11 |
| 11 | 3 | 1.8 | 6 | 7 | 6.1 | 11 |
| 12 | 2 | 2 | 6 | 6 | 6.1 | 11 |
| 13 | — | 1.8 | — | — | 8.1 | 13 |

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A product of reaction suitable use to improve the low-temperature properties of liquid hydrocarbyl fuels obtained by reacting a hydrocarbyl aminodiol or mixture of hydrocarbyl aminodiols and a reactive acid/anhydride product derived from the reaction of pyromellitic dianhydride with an aminoalcohol, derived from an amine and an epoxide or a combination of such aminoalcohols using standard esterification techniques in accordance with the following stepwise procedure:

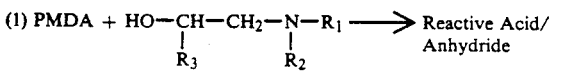

(1) PMDA + HO—CH(R3)—CH2—N(R2)—R1 ⟶ Reactive Acid/Anhydride (2) Reactive Acid/Anhydride + HO—R5OH— Oligomer/Polymer where HO—$R_5$—OH=aminodiol(s)

$R_1$, $R_3$=$C_8$ to $C_{50}$ hydrocarbyl, $R_2$=$R_1$, $C_1$ to about $C_{100}$ hydrocarbyl, or hydrocarbyl-containing phosphorus, nitrogen sulfur and/or oxygen and where said reaction is carried out with less than molar, more than molar and substantially molar ratios of the reactants, the temperature varies from 100° C. to 250° C. and the pressure varies from 0.001 to 10 atm.

2. The product of claim 1 where the aminodiol is derived from the reaction of a primary amine or a bis-secondary amine with two or more equivalents of an epoxide.

3. The product of claim 1 where the oligomer/polymer is derived from pyromellitic dianhydride partial ester and aminodiol and has a generalized structure as follows:

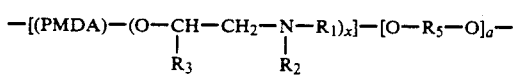

—[(PMDA)—(O—CH(R3)—CH2—N(R2)—R1)x]—[O—R5—O]a— where a=0.25 to about 2 x=0.5 to about 3.5.

4. The product of claim 1 where the oligomer/polymer is derived from pyromellitic dianhydride mixed partial ester and aminodiol and has a generalized structure as follows:

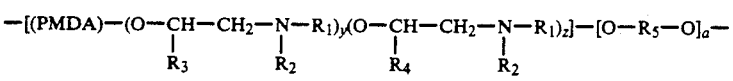

—[(PMDA)—(O—CH(R3)—CH2—N(R2)—R1)y(O—CH(R4)—CH2—N(R2)—R1)z]—[O—R5—O]a— where a=0.25 to about 2 y+z=0.5 to about 3.5 and $R_4$=hydrogen or $C_1$ to about $C_{100}$ hydrocarbyl or $C_1$ to about $C_{100}$ hydrocarbyl containing phosphorus, nitrogen, sulfur and/or oxygen.

5. The product of claim 1 where the oligomer/polymer is derived from pyromellitic dianhydride partial ester/amide and aminodiol and has a generalized structure as follows:

+(PMDA)—(O—CH(R3)—CH2—N(R2)—R1)y(N(R2)—R1)z]—[O—R5—O+a where y+z=0.5 to about 3.5, and a=0.25 to 2.

6. The product of claim 1 obtained by reacting aniline, 1,2-epoxyoctadecane, di(hydrogenated tallow) amine and pyromellitic dianhydride.

7. The product of claim 1 obtained by reacting piperazine, 1,2-epoxyoctadecane, di(hydrogenated tallow) amine and pyromellitic dianhydride.

8. The product of claim 1 obtained by reacting n-octylamine, 1,2-epoxyoctadecane, di(hydrogenated tallow) amine and pyromellitic dianhydride.

9. The product of claim 1 obtained by reacting hydrogenated tallow amine, 1,2-epoxyoctadecane, di(hydrogenated tallow) amine and pyromellitic dianhydride.

10. The product of claim 1 obtained by reacting di(hydrogenated tallow amine, 1,2-epoxyoctadecane, an aminodiol derived from tallow amine and two equivalents of ethylene oxide, and pyromellitic dianhydride.

11. The product of claim 1 obtained by reacting di(hydrogenated tallow) amine and 1,2-epoxyoctadecane, an aminodiol derived from tallow amine and five equivalents of ethylene oxide, and pyromellitic dianhydride.

12. A fuel composition comprising a major amount of a liquid hydrocarbyl fuel and a minor amount of from about 0.001% to about 10% based on the total weight of the composition of an additive product of reaction obtained by reacting a hydrocarbyl aminodiol or mixture of hydrocarbyl aminodiols and a reactive acid/anhydride product derived from the reaction of pyromellitic dianhydride with an aminoalcohol, the product of an amine and an epoxide or a combination of such aminoalcohols via standard esterification techniques in the following stepwise procedure:

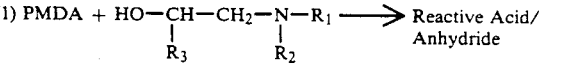

(1) PMDA + HO—CH(R3)—CH2—N(R2)—R1 ⟶ Reactive Acid/Anhydride (2) Reactive Acid/Anhydride + HO—R5OH— Oligomer/Polymer where HO—$R_5$—OH=aminodiol(s)

$R_1$, $R_3$=$C_8$ to $C_{50}$ hydrocarbyl, $R_2$=$R_1$, $C_1$ to about $C_{100}$ hydrocarbyl, or hydrocarbyl-containing phosphorus, nitrogen sulfur and/or oxygen and where said reaction is carried out with less than molar, more than molar and substantially molar ratios of the reactants, the temperature varies from 100° C. to 250° C. and the pressure varies from 0.001 to 10 atm.

13. The composition of claim 12 where the aminodiol is derived from the reaction of a primary amine or a bis-secondary amine and two or more equivalents of an epoxide.

14. The composition of claim 12 where the oligomer/polymer is derived from pyromellitic dianhydride partial ester and aminodiol and has a generalized structure as follows:

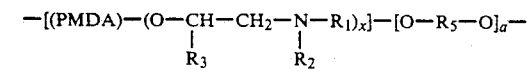

where a=0.25 to about 2 x=0.5 to about 3.5.

15. The composition of claim 12 where the oligomer/polymer is derived from from pyromellitic dianhydride partial mixed ester and aminodiol and has a generalized structure as follows:

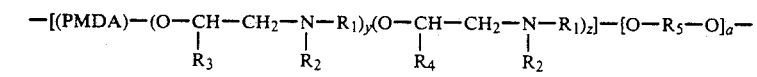

where a=0.25 to about 2 y+z=0.5 to about 3.5 and $R_4$=hydrogen or $C_1$ to about $C_{100}$ hydrocarbyl or $C_1$ to about $C_{100}$ hydrocarbyl containing phosphorus, nitrogen, sulfur and/or oxygen.

16. The composition of claim 12 where the oligomer/polymer is derived from from pyromellitic dianhydride partial ester/amide and aminodiol and has a generalized structure as follows:

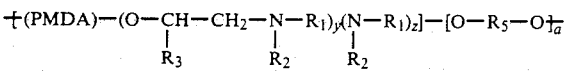

where y+z=0.5 to about 3.5, and a=0.25 to 2.

17. The composition of claim 13 where said product is obtained by reacting aniline, 1,2-epoxyoctadecane, di(hydrogenated tallow) amine and pyromellitic dianhydride.

18. The composition of claim 13 where said product is obtained by reacting piperazine, 1,2-epoxyoctadecane, di(hydrogenated tallow) amine and pyromellitic dianhydride.

19. The composition of claim 13 where said product is obtained by reacting n-octylamine, 1,2-epoxyoctadecane, di(hydrogenated tallow) amine and pyromellitic dianhydride.

20. The composition of claim 13 where said product is obtained by reacting hydrogenated tallow amine, 1,2-epoxyoctadecane, di(hydrogenated tallow) amine and pyromellitic dianhydride.

21. The composition of claim 13 where said product is obtained by reacting di(hydrogenated tallow) amine, 1,2-epoxyoctadecane, an aminodiol derived from tallow amine and two equivalents of ethylene oxide, and pyromellitic dianhydride.

22. The composition of claim 13 where said product is obtained by reacting di(hydrogenated tallow) amine and 1,2-epoxyoctadecane, an aminodiol derived from tallow amine and five equivalents of ethylene oxide, and pyromellitic dianhydride.

23. The composition of claim 12 where said fuel is a liquid hydrocarbon combustible fuel.

24. The composition of claim 23 where said fuel is a distillate fuel.

25. The composition of claim 23 where said distillate fuel is selected from fuel oils.

26. The composition of claim 25 where the fuel oils are selected from heating oil Nos. 1, 2 and 3 and diesel fuel oil.

27. The composition of claim 26 where the fuel oil is a heating fuel oil.

28. The composition of claim 26 where the fuel oil is a diesel fuel oil.

29. The composition of claim 14 where said minor amount comprises from about 0.01% to about 5% wt.

30. A process for preparing an additive product of reaction comprising reacting in different ratios a hydrocarbyl aminodiol or mixture of hydrocarbyl aminodiols and a reactive acid/anhydride product derived from the reaction of pyromellitic dianhydride with an aminoalcohol, derived from an amine and an epoxide or a combination of such aminoalcohols and where said reaction is carried out with less than molar, more than molar and substantially molar ratios of the reactants, the temperature varies from 100° C. to 250° C. and the pressure varies from 0.001 to 10 atm.

31. The process of claim 30 where the aminodiol is derived from the reaction of a primary amine or a bis-secondary amines and two or more equivalents of an epoxide.

32. The process of claim 30 where the process is a one-pot process.

33. The process of claim 30 where the product is obtained via standard esterification techniques in the following stepwise procedure

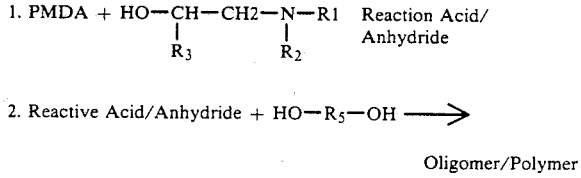

where

HO—$R_5$—OH=aminodiols(s)

$R_1$, $R_3$=$C_8$ to $C_{50}$ hydrocarbyl, $R_2$=$R_1$, $C_1$ to about $C_{100}$ hydrocarbyl, or hydrocarbyl containing phosphorus, nitrogen, sulfur and/or oxygen.

34. The process of claim 33 where the oligomer/polymer is derived from pyromellitic dianhydride partial ester and aminodiol and has a generalized structure as follows:

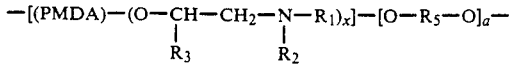

where a=0.25 to about 2 x=0.5 to about 3.5.

35. The process of claim 33 where the oligomer/polymer is derived from pyromellitic dianhydride partial mixed ester and aminodiol and has a generalized structure as follows:

$$-[(PMDA)-(O-\underset{R_3}{\underset{|}{CH}}-CH_2-\underset{R_2}{\underset{|}{N}}-R_1)_y(O-\underset{R_4}{\underset{|}{CH}}-CH_2-\underset{R_2}{\underset{|}{N}}-R_1)_z]-[O-R_5-O]_a-$$

where a=0.25 to about 2 y+z=0.5 to about 3.5 and $R_4$=hydrogen or $C_1$ or about $C_{100}$ hydrocarbyl or $C_1$ to about $C_{100}$ hydrocarbyl containing phosphorus, nitrogen, sulfur and/or oxygen.

36. The process of claim 33 where the oligomer/polymer is derived from pyromellitic dianhydride partial ester/amide and aminodiol and has a generalized structure as follows:

$$\dagger(PMDA)-(O-\underset{R_3}{\underset{|}{CH}}-CH_2-\underset{R_2}{\underset{|}{N}}-R_1)_y(\underset{R_2}{\underset{|}{N}}-R_1)_z]-[O-R_5-O\dagger_a$$

where y+z=0.5 to about 3.5 and a=0.25 to 2.

37. A concentrate solution suitable for use in preparing liquid hydrocarbyl fuels comprising an inert solvent and an additive product of reaction as described in claim 1 having a total volume of 100 ml and dissolved therein about 10 g of said additive product.

38. The solution of claim 37 where said solvent is a hydrocarbon solvent.

39. The solution of claim 38 where the solvent is a xylene or mixed xylenes.

40. A method of improving the low temperature characteristics of a liquid hydrocarbyl fuel comprising adding thereto a minor amount of from about 0.001% to about 10% wt, based on the total weight of the composition of an additive product as described in claim 1.

* * * * *

UNITED STATES PATENT AND TRADEMARK OFFICE

CERTIFICATE OF CORRECTION

PATENT NO. : 5,039,309

DATED : August 13, 1991

INVENTOR(S) : David J. Baillargeon et al.

It is certified that error appears in the above-identified patent and that said Letters Patent is hereby corrected as shown below: On the title page and Col. 1, line 1 reads "MULTIFUNCTIONS ADDITIVES" should read --MULTIFUNCTIONAL ADDITIVES--.

Signed and Sealed this

Twentieth Day of April, 1993

*Attest:*

MICHAEL K. KIRK

*Attesting Officer*

*Acting Commissioner of Patents and Trademarks*